United States Patent [101]

Iwamitsu et al.

[11] 4,052,859

[45] Oct. 11, 1977

[54] METHOD AND APPARATUS OF COMPLETING SLURRY SHIELD TUNNELING AT VERTICAL SHAFT

[75] Inventors: Yasuyuki Iwamitsu, Ichikawa; Shigeru Kobayashi, Tokyo, both of Japan

[73] Assignee: Tekken Construction Co. Ltd., Japan

[21] Appl. No.: 732,045

[22] Filed: Oct. 13, 1976

[30] Foreign Application Priority Data

Feb. 12, 1976 Japan ..... 51-13155

[51] Int. Cl.[2] ..... E21D 9/04

[52] U.S. Cl. ..... 61/42; 61/45 R; 61/84

[58] Field of Search ..... 61/42, 45, 84, 85, 41; 299/11; 175/62

[56] References Cited

U.S. PATENT DOCUMENTS

| | | | |
|---|---|---|---|
| 2,325,565 | 7/1943 | Williams | 61/42 |
| 3,260,054 | 7/1966 | Lorenz | 61/42 |

*Primary Examiner*—Jacob Shapiro

*Attorney, Agent, or Firm*—Pierce, Scheffler & Parker

[57] ABSTRACT

A method of completing a tunnel excavation with a slurry shield type tunneling machine through a soft ground having a high water content or much gushing water, advancing the machine from the ground into a vertical shaft at, for example, a tunnel terminating point while preventing any ground collapse or gushing water at a vertical shaft wall finally excavated, and an apparatus for performing the method. A substantially ring-shaped liquid-tight packing means having an inner diameter large enough for passing therethrough the machine while maintaining a liquid-tight sealing around the outer periphery of the machine is provided at a position of a final tunnel port on a shaft wall at which the machine reaches the vertical shaft and along the inside surface of sheet piles struck in advance on the vertical shaft wall, a pressurized liquid chamber having substantially the same diameter as that of the packing means is formed in the vertical shaft so as to open on the packing means side, the liquid pressure in said chamber is kept at least as high as ground water pressure or ground pressure, the sheet pile is removed from the final port position, and the machine is then propelled to pass through the remaining ground layer and packing means and is receptacled in the pressure chamber. After backfilling around the final port is completed, the chamber and machine are removed.

13 Claims, 3 Drawing Figures

METHOD AND APPARATUS OF COMPLETING SLURRY SHIELD TUNNELING AT VERTICAL SHAFT

FIELD OF THE INVENTION

The present invention relates to a method and apparatus of completing a tunnel excavation through a soft ground of high water content or much gushing water with a slurry shield type tunneling machine and, more particularly, to a method of advancing the slurry shield type tunneling machine into a vertical shaft made at a tunnel terminating position or the like out of the soft and unstable ground having a high water content or much gushing water while keeping the soft ground stable and an apparatus for performing said method.

BACKGROUND OF THE INVENTION

In conventional tunneling excavations of the kind referred to, when the tunneling machine reaches the vertical shaft, it has been necessary to have the tunneling machine advanced into the shaft after providing a hole in a retaining wall such as, for example, a sheet pile or concrete wall disposed along an inside wall of the vertical shaft. If the hole is made in the shaft wall, however, highly water containing soil or gushing water will flow out of the soft ground and, in order to prevent such risks, the ground layer adjacent the vertical shaft has been improved by applying auxiliary processes for preventing ground collapse and gushing water such as a chemical grouting impregnating process, CCP process, well point process, ground water freezing process or the like in advance of propelling the tunneling machine. Therefore, a considerable number of days and cost have been required to determine and perform a proper type of the auxiliary process depending on various conditions of the soft ground layer. However, such auxiliary process has been indispensable in the cases of making tunnels for public facilities or the like in a soft ground under cities or the like located at a very low level place or even below the sea level.

SUMMARY OF THE INVENTION

The present invention has been suggested to remove such defects in the conventional method in such that a liquid-tight pressure chamber is provided in a vertical shaft to face through a packing means a shaft wall at a position of final tunnel port to be reached by the tunneling machine, the pressure chamber is filled with such a liquid body as a slurry, muddy water or simply water, the pressure of the filled liquid is kept high enough to resist against underground water pressure or tunnel face ground pressure, the ground to be finally excavated is exposed to the pressurized liquid when the tunneling machine is propelled into the pressure chamber through the packing means and, at the same time, the liquid in the pressure chamber is made to flow out to keep the pressure constant.

A primary object of the present invention is to provide a highly efficient method and apparatus of completing a tunnel excavation with a slurry shield type tunneling machine at a vertical shaft in a soft ground having a high water content and much gushing water, effectively enabling one to omit any auxiliary process conventionally required prior to the time when the tunneling machine is advanced into the vertical shaft out of the soft ground for preventing ground collapse or gushing water.

Another object of the present invention is to provide a simple and yet safe method and apparatus of advancing the slurry shield type tunneling machine into a vertical shaft from a soft ground of a high water content or the like.

BRIEF DESCRIPTION OF THE DRAWINGS

Other objects and advantages of the present invention shall become clear upon reading the following explanation detailed with reference to preferred embodiments of the present invention shown in the accompanying drawings, in which.

DETAILED DESCRIPTION OF PREFERRED EMBODIMENTS

While the present invention will be detailed with reference to the preferred embodiments shown, it will be understood that the intention is not to limit the invention to the particular embodiments but rather to include all alterations, modifications, and equivalent arrangements possible within the scope of appended claims.

Figure 1:
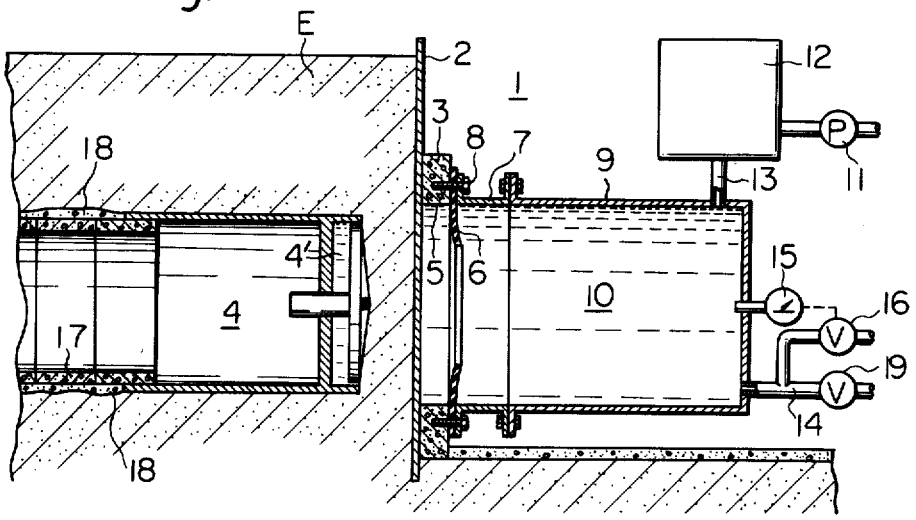
FIG. 1 shows an embodiment of the present invention in a schematic sectioned view of a liquid pressure chamber provided in a vertical shaft and a slurry shield type tunneling machine having reached a position in the ground adjacent the vertical shaft.

Referring now to FIG. 1, a vertical shaft 1 is dug from the ground surface in a terminating position of such tunnel to be made with a slurry shield type tunneling machine 4 under the ground surface of a soft ground E of a high water content as, for example, a public facility tunnel for laying therein water pipes, gas pipes, telephone cables or the like, or an underground railway tunnel and sheet piles 2 for retaining peripheral ground surfaces of the vertical shaft 1 are struck into the ground E. In the position on the sheet piles 2 to be reached by the tunneling machine 4, a concrete side wall 3 having a hole 5 of a diameter large enough to pass the generally cylindrical tunneling machine 4 is formed in a liquid-tight manner against the inside surface of the sheet piles 2. A ring-shaped packing member 6 made of such flexible material as, for example, a plate-shaped rubber and extending toward the center of the hole 5 so as to be of a length well larger than the difference between the diameter of the hole 5 and that of the tunneling machine 4 is liquid-tightly fitted to the inside surface of the side wall 3 around the hole 5, a ring-shaped member 7 having substantially the same diameter as of the hole 5 and a substantially cylindrical form made, for example, of a metal is fixed to the side wall 3 by means of bolts 8 in alignment with the hole 5 through said packing member 6. Then a substantially cup-shaped bulkhead member 9 of substantially the same diameter as of the ring member 7 and having, in this case, a length long enough to contain the body of the tunneling machine 4 is liquid-tightly fitted to the end surface of the ring member 7 to form a liquid pressure chamber 10. A pump 11 for feeding such a liquid as a slurry, muddy water or water under an elevated pressure and a pressure water tank 12 are connected to this pressure chamber 10 through a feed pipe 13 and an outlet pipe 14 is fitted to the tank. The outlet pipe 14 is branched into two sections, one of which is provided with a valve 16 opening and closing in response preferably electromagnetically to outputs of a pressure gauge 15 communicating with the inside of the pressure chamber 10 to measure its internal pressure and the other of which is provided, in the present instance, with a manual valve 19. The valve 16 is to keep the pressure in the chamber 10 constant in response to the pressure variation in the case of advancing the tunneling machine 4 into the pressure chamber 10 from the ground E, and the valve 19 is to drain all the liquid in the chamber 10 after the tunneling machine 4 is completely housed in the pressure chamber 10 and the final tunnel port is completed. The tunneling machine 4 has a slurry pressure chamber 4' behind a rotary cutter head at the head part, which communicates with a tunneling face of the ground E, and this pressure chamber 4' has a shield slurry feeding and discharging system (not illustrated) for feeding a slurry, muddy water or water from the exterior to the chamber 4' under a pressure elevated to be as high as or higher than the ground water pressure or ground pressure that is exerted on the tunneling face and discharging from the chamber 4' excavated soil or the like to the exterior with the fed slurry or the like. Ring or pipe-shaped tunnel wall segments 17 made usually of concrete are installed sequentially on the tunnel wall surface excavated behind the tunneling machine 4 and such back-filling agent 18 as mortar is impregnated to fill all clearance between the outer periphery of the segments 17 and the ground layer preferably through the segments 17.

Figure 2:
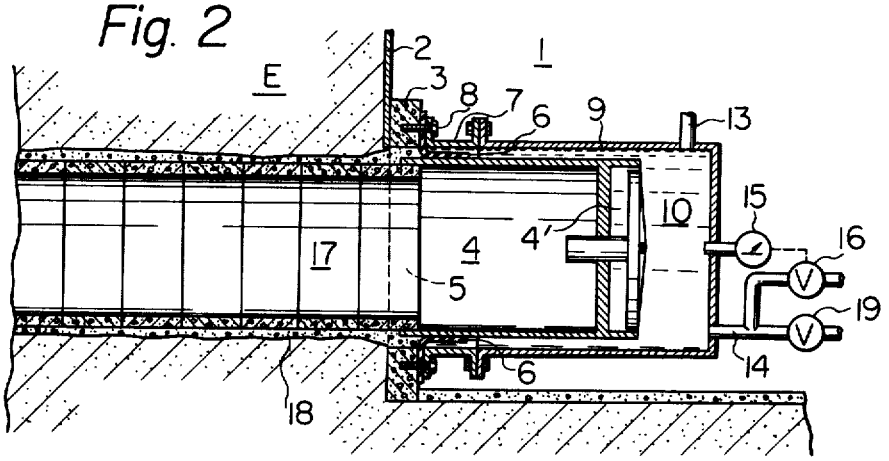
FIG. 2 is substantially the same sectioned view as FIG. 1, showing the tunneling machine as further advanced into the liquid pressure chamber in the vertical shaft after forming a final tunnel port.

The operation of the invention with the above described arrangement shall be explained in the following. In FIG. 1, the tunneling machine 4 is shown as having reached a position adjacent the vertical shaft 1. In this state, the pressure of the slurry, muddy water or water with which the liquid pressure chamber 10 is filled is kept as high as or higher than the underground water pressure or ground pressure of the ground layer E. Then, the sheet piles 2 in the part closing the hole 5 in the concrete side wall 3 are pulled up. As the ground E facing the hole 5 exposed here is subjected to and supported by the pressure of the liquid pressure chamber 10, its collapse or gushing water can be well prevented. The tunneling machine 4 is further propelled to reach the hole 5 by tunneling the remaining ground layer facing the hole 5 and is advanced into the pressure chamber 10 by pushing the packing 6 bowingly so as to be in the state shown in FIG. 2. The concrete segments 17 are further added in the rear of the propelled tunneling machine, the last segments opposed to the concrete side wall 3 are installed, and the back-filling mortar 18 is impregnated up to a clearance between the outer periphery of the last segments and the inner periphery of the hole 5 in the side wall 3 so as to complete the final tunnel port in the vertical shaft.

As the tunneling machine 4 advances into the pressure chamber 10 and the machine's pressure chamber 4' in its head and the pressure chamber 10 communicate with each other, the pressure in the chamber 10 will possibly fluctuate but such substantially momentary fluctuation will be absorbed by the slurry feeding and discharging system on the side of the tunneling machine 4 where the pressure is generally automatically controlled. When the tunneling machine 4 further advances, the liquid pressure in the chamber 10 on the vertical shaft side will increase with the decrease of the volume of said chamber, this increase will be detected by the pressure gauge 15 and the valve 16 will be opened properly so as to keep the pressure chamber 10 at a constant pressure. When the periphery of the final tunnel port is completed as described above and the tunneling machine 4 is housed completely in the pressure chamber 10 so that the machine 4 can be separated from the last tunnel wall segments 17, the valve 19 will be opened to discharge all the liquid in both pressure chambers 4' and 10, the bulkhead member 9 will be removed and the tunneling machine 4 will be removed out of the final tunnel port.

Figure 3:
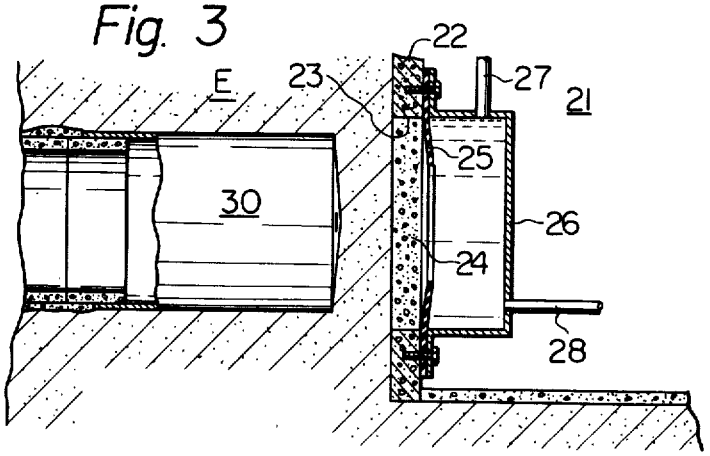
FIG. 3 is substantially the same sectioned view as FIG. 1, showing another embodiment of the present invention.

FIG. 3 shows another embodiment useful specifically in the case where the underground water pressure in the ground E is comparatively low so that the risks of the gushing water or ground collapse may not be so high. In the drawing, the ground retainer on the vertical shaft side wall at the position expected to be reached by the tunneling machine 30 in a vertical shaft 21 is formed as a concrete side wall 22 and a part to be a final tunnel port 23 of the side wall in the present case is cast, for example, of a foaming mortar 24 which is easy to crush but is liquid-tight to keep the port closed. A bulkhead member 26 which is of a diameter a little larger than that of the tunneling machine 30 which is substantially cylindrical but is, in the present instance, short enough for housing only the tunneling machine head part is fitted to the concrete side wall 22 in a liquid-tight manner as aligned with the port 23 through a packing member 25 which is similar to the one used in the embodiment of FIG. 1. The bulkhead member 26 is filled through a feed pipe 27 with such a liquid as a slurry, muddy water or water under a pressure at least as high as the underground water pressure or the ground pressure exerted on the head part of the tunneling machine 30. This bulkhead member 26 is provided also with an outlet pipe 28 for the liquid to balance the incremental pressure in the bulk head at the time of advancing the tunneling machine 30 into the bulkhead member 26 and to drain all the liquid out of the head when the latter is removed from the side wall 22.

The operating steps of this embodiment shall be described. While the bulkhead member 26 is filled with the liquid such as a slurry, muddy water or water properly selected and under the elevated pressure, the tunneling machine 30 is propelled toward the expected final tunnel port 23 and the foaming mortar 24 is crushed with the rotary cutter head of the tunneling machine 30. The machine 30 advances by pushing the packing member 25 resiliently bowingly and the machine's head part reaches the bulkhead member 26. As the packing member 25 closes the clearance on the outer periphery of the tunneling machine, any outflow of ground soil or the like or gushing water into the vertical shaft 21 out from the ground E can be prevented. In this state, the liquid in the bulkhead member 26 is discharged and the bulkhead is removed. Thus, the tunneling machine 30 is further propelled, the tunnel wall segments are installed sequentially in the rear of the tunneling machine as the same advances, any clearance around their outer periphery is filled with the back-filling agent impregnated until the final tunnel port 23 is reached so that any outflow of the underground water or gushing water into the vertical shaft can be prevented, thus the tunneling excavation is completed and the bulkhead member 26 as well as the tunneling machine 30 are removed.

As described above, according to the present invention, in the case of having the tunneling machine reached the vertical shaft while connecting the tunnel made in the highly water containing soft ground layer with the vertical shaft, a pressurized liquid chamber shielded in advance is formed to face the expected final tunnel port, the tunneling machine is receptacled in the pressure chamber while keeping a pressure which can resist the underground water pressure, whereby the auxiliary process required conventionally for improving the ground layer adjacent the vertical shaft can be omitted effectively and the working period and costs can be minimized while required safety of the working is well retained.

What is claimed is:

1. A method of completing at a vertical shaft a tunneling through a highly water containing soft ground with a slurry shield type tunneling machine comprising steps of a. providing a side wall having an initially closed final tunnel port of a diameter larger than that of said tunneling machine at a position along a vertical shaft wall where said tunneling machine is to reach, b. defining a liquid-tight chamber inside the shaft and communicating with said tunnel port, c. filling said liquid-tight chamber with a liquid under a pressure capable of resisting a pressure applied to said side wall by the soft ground, d. opening the tunnel port with advances of the tunneling machine through the ground and tunnel port into the liquid-tight chamber while keeping said liquid pressure in the chamber substantially constant, and e. closing clearances between tunnel wall segments installed behind the machine and peripheral edges of the tunnel port in a liquid-tight manner.

2. A method according to claim 1 wherein said step of providing the side wall comprises steps of striking sheet piles into the ground along the vertical shaft wall and securing a concrete side wall element having said final tunnel port against said sheet piles, and said step of opening the tunnel port comprises a step of removing the sheet piles out of their position closing the port.

3. A method according to claim 1 wherein said step of providing the side wall comprises a step of making a concrete side wall having said final tunnel port which is closed with an easy crushable concrete, and said step of opening the tunnel port comprises a step of crushing said crushable concrete by means of rotated cutter head of the tunneling machine with the advances of the machine.

4. A method according to claim 3 wherein said easy crushable concrete is a foamed concrete.

5. A method according to claim 1 wherein said step of defining the liquid-tight chamber comprises steps of securing a resilient packing means around said final tunnel port of the side wall, said packing means extending toward the center of the tunnel port so as to achieve a resilient liquid-tight sealing around the outer periphery of the tunneling machine, and mounting a substantially cup-shaped bulkhead member having substantially the same diameter as that of the tunnel port to the side wall liquid-tightly through the packing means at the open end of the member and in alignment with the tunnel port.

6. A method according to claim 1 wherein said liquid flled in said liquid-tight chamber is selected from a group consisting of a slurry, muddy water and water.

7. A method according to claim 1 wherein said pressure of the liquid filled in said liquid-tight chamber is higher than said pressure applied by the soft ground.

8. A method of advancing a slurry shield type tunneling machine through a highly water containing soft ground into a vertical shaft while retaining such ground at vertical shaft walls stable, comprising steps of providing a concrete retaining wall at least against a vertical shaft wall on the side where said tunneling machine is to reach, said concrete retaining wall having a hole of a diameter large enough for freely passing therethrough the tunneling machine and closed by a removable closure means, mounting a substantially cylindrical liquid-tight pressure chamber opened at an axial end and having dimensions capable of accommodating at least the head part of the tunneling machine to said concrete retaining wall liquid-tightly at said opened end through a substantially ring-shaped resilient packing means secured around said hole of the wall in respectively axially aligned relation to each other, said packing means extending toward the center of the hole so as to be engageable resiliently as bowed with the outer peripheral surface of the tunneling machine when the same is in the hole, filling said pressure chamber with a liquid under a pressure at least equal to underground water pressure in the ground, having said closure means removed out of the hole in the retaining wall when the tunneling machine advanced through the ground reaches and passes the hole, and controllably draining the liquid from the pressure chamber to keep the liquid pressure substantially constant when the tunneling machine is further advanced into the pressure chamber.

9. An apparatus for liquid-tightly shielding a wall of a vertcial shaft at final port position of a tunnel to be excavated through highly water containing soft ground with a slurry shield type tunneling machine, comprising a ground retaining side wall installed against said vertical shaft wall and having a hole of a diameter capable of freely passing therethrough said machine when the machine reaches the vertical shaft, means removably closing said hole of the side wall, a resilient packing means secured to the side wall around the hole and extending toward the center of the hole so as to be engageable resiliently as bowed and liquid-tightly with the outer periphery of the machine, a liquid pressure chamber opened at one end and removably mounted at said opened end to the side wall liquid-tightly through said packing means, said chamber having dimensions capable of accommodating at least the head part of the machine, means for feeding a liquid into said pressure chamber under a pressure capable of resisting underground water pressure in the soft ground, and means including a drainage for maintaining said liquid pressure constant when the machine passed through the ground advances into the pressure chamber.

10. An apparatus according to claim 9 wherein said side wall is a concrete block and said means removably closing said hole of the side wall is a sheet pile.

11. An apparatus according to claim 9 wherein said side wall is a concrete block and said means removably closing said hole of the side wall is a foamed concrete filled in the hole and easily crushable by the tunneling machine advanced therethrough.

12. An apparatus according to claim 9 wherein said pressure chamber is of dimensions capable of accommodating the whole body of the tunneling machine.

13. An apparatus according to claim 9 wherein said pressure retaining means comprises a pressure detecting means and a valve controllably opening and closing said drainage responsive to said pressure detecting means.

* * * * *